US011353808B1

(12) United States Patent
Umekubo et al.

(10) Patent No.: US 11,353,808 B1
(45) Date of Patent: Jun. 7, 2022

(54) POWDER TRANSPORTING DEVICE AND IMAGE FORMING APPARATUS

(71) Applicant: FUJIFILM Business Innovation Corp., Tokyo (JP)

(72) Inventors: Kazuya Umekubo, Kanagawa (JP); Kiyohito Horii, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/411,646

(22) Filed: Aug. 25, 2021

(30) Foreign Application Priority Data

Mar. 29, 2021 (JP) ..... JP2021-054458

(51) Int. Cl.
*G03G 15/08* (2006.01)
*G03G 15/01* (2006.01)
*G03G 21/16* (2006.01)

(52) U.S. Cl.
CPC ..... *G03G 15/0891* (2013.01); *G03G 15/0121* (2013.01); *G03G 15/087* (2013.01); *G03G 15/0808* (2013.01); *G03G 15/0856* (2013.01); *G03G 15/0868* (2013.01); *G03G 15/0887* (2013.01); *G03G 21/1676* (2013.01); *G03G 2215/0802* (2013.01); *G03G 2215/0836* (2013.01)

(58) Field of Classification Search
CPC ..... G03G 15/0121; G03G 15/0808; G03G 15/0856; G03G 15/0868; G03G 15/087; G03G 15/0877; G03G 15/0887; G03G 15/0891; G03G 21/1676; G03G 2215/0802; G03G 2215/0836
See application file for complete search history.

(56) References Cited

U.S. PATENT DOCUMENTS

2007/0274741 A1* 11/2007 Shiraishi ..... G03G 15/0893 399/254
2009/0041508 A1* 2/2009 Oshikawa ..... G03G 15/0844 399/254
2009/0220266 A1* 9/2009 Shiraishi ..... G03G 15/0879 399/58

FOREIGN PATENT DOCUMENTS

JP 08-190243 A 7/1996
JP 2001-265088 A 9/2001
JP 2009-069511 A 4/2009

* cited by examiner

*Primary Examiner* — Joseph S Wong
(74) *Attorney, Agent, or Firm* — Sughrue Mion, PLLC

(57) ABSTRACT

A powder transporting device includes: a circulation path that receives and accommodates a developer from multiple toner cartridges filled with the developer, and along which the accommodated developer is transported while circulating; a first supply port that allows the developer to be fed onto the circulation path; a transport path that merges with the circulation path at a portion of the circulation path upstream from the first supply port to allow the developer to be transported therealong into the circulation path; a second supply port through which the developer is fed to the transport path; a detector that detects the developer accommodated in the circulation path; a first transporter that transports the developer in the circulation path at a first transport speed; and a second transporter that extends along the transport path in the circulation path, and that transports the developer into the circulation path at a second transport speed higher than the first transport speed.

20 Claims, 8 Drawing Sheets

POWDER TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2021-054458 filed Mar. 29, 2021.

BACKGROUND

(i) Technical Field

The present disclosure relates to a powder transporting device and an image forming apparatus.

(ii) Related Art

An image forming apparatus including a toner replenishment device that replenishes a single device, which is a development device, with toner is known. Multiple suction uniaxial eccentric screw pumps connected in parallel to each other are used as examples of the toner replenishment device (Japanese Unexamined Patent Application Publication No. 2009-69511).

The following development device that includes multiple development units rotatably disposed is also known (Japanese Unexamined Patent Application Publication No. 8-190243). Each development unit includes a toner feeder, a toner cartridge, and a development member. The toner feeder is hollow cylindrical, and has a toner intake port in a first side surface at a first end portion, and a toner supply port in a second side surface at a second end opposite to the first side surface. The toner feeder includes a toner transport auger inside. The toner cartridge feeds toner through the toner intake port into the toner feeder. The development member has a toner replenishment port open at a position continuous with the toner supply port. The development device also includes a developer reservoir in the second side surface of the toner feeder at a portion opposing the toner supply port. In the developer reservoir, the distance between the first side surface and the second side surface is further increased than that in the adjacent portion.

SUMMARY

Aspects of non-limiting embodiments of the present disclosure relate to a structure that prevents a developer from clogging in a circulation path to stably discharge the developer to the development device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder transporting device including: a circulation path that receives and accommodates a developer from multiple toner cartridges filled with the developer, and along which the accommodated developer is transported while circulating; a first supply port that allows the developer to be fed onto the circulation path; a transport path that merges with the circulation path at a portion of the circulation path upstream from the first supply port to allow the developer to be transported therealong into the circulation path; a second supply port through which the developer is fed to the transport path; a detector that detects the developer accommodated in the circulation path; a first transporter that transports the developer in the circulation path at a first transport speed; and a second transporter that extends along the transport path in the circulation path, and that transports the developer into the circulation path at a second transport speed higher than the first transport speed.

BRIEF DESCRIPTION OF THE DRAWINGS

Exemplary embodiments of the present disclosure will be described in detail based on the following figures, wherein.

DETAILED DESCRIPTION

With reference to the drawings, the present disclosure will be described further in detail below while taking exemplary embodiments and specific examples as examples. However, the present disclosure is not limited to these exemplary embodiments and specific examples.

In the following description with reference to the drawings, the drawings are schematic, and have the ratios between the dimensions different from the actual ones. For ease of understanding, components other than those used for the description are omitted from the drawings as appropriate.

For ease of understanding the following description, throughout the drawings, the front-rear direction is indicated as an X axis direction, the left-right direction is indicated as a Y axis direction, and the vertical direction is indicated as a Z axis direction.

Figure 1:
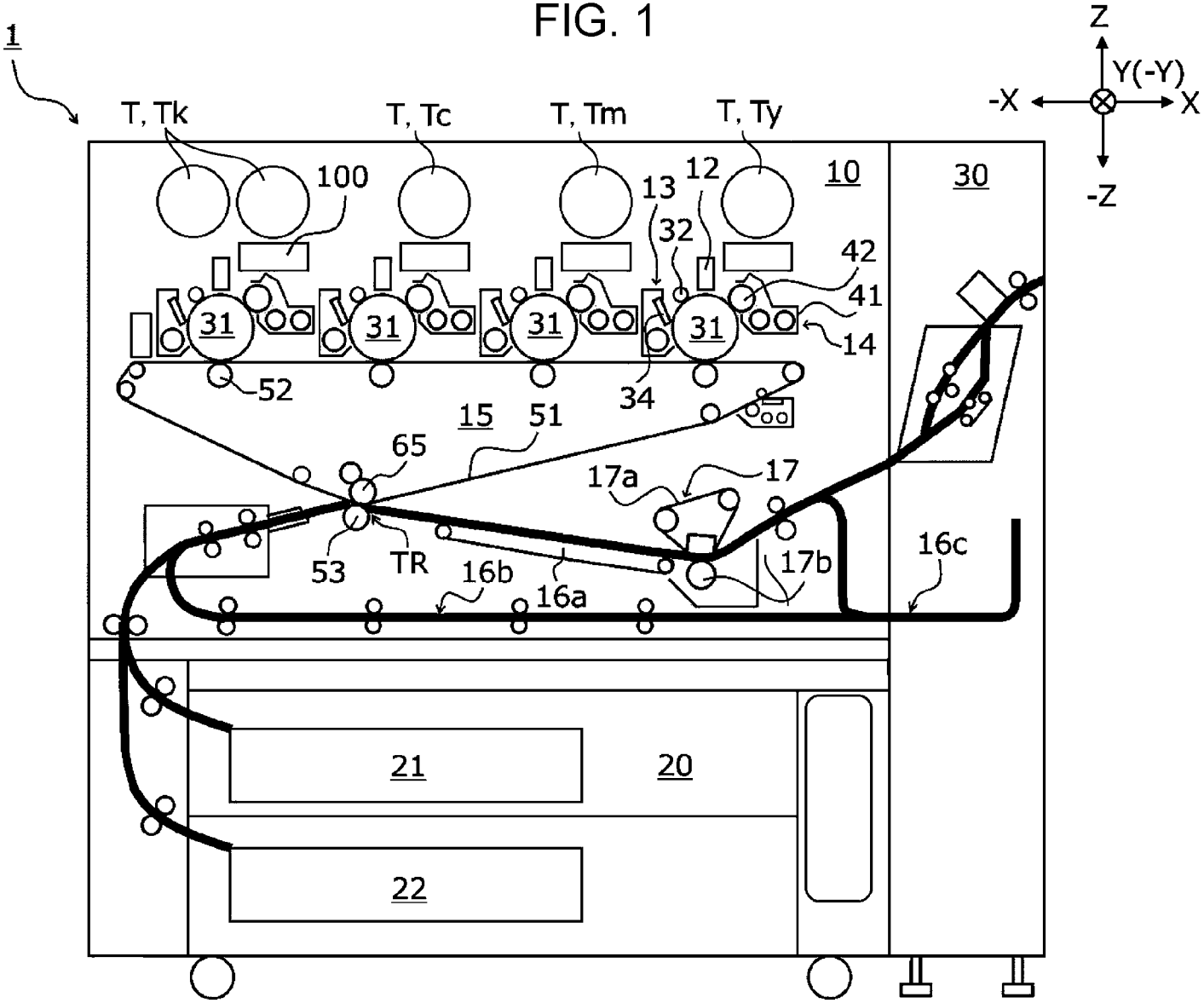
FIG. 1 is a cross-sectional schematic diagram of an example of a schematic structure of an image forming apparatus.

(1) Entire Structure and Operation of Image Forming Apparatus (1.1) Entire Structure of Image Forming Apparatus FIG. 1 is a cross-sectional schematic diagram of an example of a schematic structure of an image forming apparatus 1 according to the present exemplary embodiment.

The image forming apparatus 1 includes an image forming portion 10, a sheet feeder 20 attached to a first end of the image forming portion 10, a sheet discharger 30 disposed at a second end of the image forming portion 10 and to which printed sheets are discharged, and an image processor (not illustrated) that generates image information based on print information transmitted from a host device.

The image forming portion 10 includes a system controller (not illustrated), exposure devices 12, photoconductor units 13, development devices 14, a transfer device 15, sheet transport devices 16*a*, 16*b*, and 16*c*, a fixing device 17, and a driving device (not illustrated). The image forming portion 10 forms image information received from the image processor into a toner image on a sheet fed from the sheet feeder 20.

The sheet feeder 20 feeds sheets to the image forming portion 10. Specifically, the sheet feeder 20 includes multiple sheet containers that accommodate sheets P of different types (for example, different in material, thickness, sheet size, or paper grain). The sheet feeder 20 feeds sheets picked up from one of these sheet containers to the image forming portion 10.

The sheet discharger 30 discharges sheets carrying images output from the image forming portion 10. Thus, the sheet discharger 30 includes a discharged-sheet receiver that receives sheets to which images have been output. The sheet discharger 30 may perform postprocessing, such as cutting or stapling, on a stack of sheets output from the image forming portion 10.

(1.2) Structure and Operation of Image Forming Portion

In the image forming apparatus 1 with this structure, each sheet picked up from one of the sheet containers in the sheet feeder 20 designated by a print job is fed to the image forming portion 10 at the timing of image formation.

The photoconductor units 13 include photoconductor drums 31 that are arranged parallel to each other below the exposure devices 12 and serve as image carriers driven to rotate. A charging roller 32, the exposure device 12, the development device 14, a first transfer roller 52, and a cleaning blade 34 are arranged in the rotation direction of each photoconductor drum 31.

Each development device 14 includes a development housing 41 that accommodates a developer inside. Inside the development housing 41, a development roller 42 is disposed to oppose the corresponding photoconductor drum 31. A restrictor 45 (refer to FIG. 2) that restricts the thickness of the developer is disposed adjacent to the corresponding development roller 42.

The development devices 14 have substantially the same structure except for the development housings 41 accommodating different developers to respectively form toner images of yellow (Y), magenta (M), cyan (C), and black (K).

A replaceable toner cartridge T and a powder transporting device 100 are disposed above each development device 14. The toner cartridge T accommodates a developer (toner including a carrier). The powder transporting device 100 feeds the developer from the toner cartridge T to the development device 14. In the present exemplary embodiment, toner cartridges Ty, Tm, and Tc for yellow (Y), magenta (M), and cyan (C) and two toner cartridges Tk for black (K) are removably attached.

The surface of each rotating photoconductor drum 31 is charged by the corresponding charging roller 32 with electricity, and receives an electrostatic latent image formed from latent-image-forming light emitted from the exposure device 12. The electrostatic latent image formed on the photoconductor drum 31 is developed by the development roller 42 as a toner image.

The transfer device 15 includes an intermediate transfer belt 51, the first transfer rollers 52, and a second transfer roller 53. To the intermediate transfer belt 51, the toner images of different colors formed on the photoconductor drums 31 of the photoconductor units 13 are transferred in a superposed manner. The first transfer rollers 52 sequentially transfer (first-transfer) the toner images of different colors formed by the photoconductor units 13 to the intermediate transfer belt 51. The second transfer roller 53 collectively transfers (second-transfers) the toner images of different colors transferred to the intermediate transfer belt 51 in a superposed manner to a sheet serving as a recording medium.

The toner images of different colors formed on the photoconductor drums 31 of the photoconductor units 13 are sequentially electrostatically transferred (first-transferred) onto the intermediate transfer belt 51 by the first transfer rollers 52 that have received a predetermined transfer voltage from, for example, a power supply (not illustrated) controlled by the system controller. Thus, a superposed toner image including toner of different colors is formed.

In accordance with movement of the intermediate transfer belt 51, the superposed toner image on the intermediate transfer belt 51 is transported to the second transfer portion TR where the second transfer roller 53 is pressed against a back-up roller 65 with the intermediate transfer belt 51 interposed therebetween.

Concurrent with the arrival of the superposed toner image at the second transfer portion TR, a sheet is fed from the sheet feeder 20 to the second transfer portion TR. A predetermined second transfer voltage is applied from a power supply controlled by the system controller to the back-up roller 65 that opposes the second transfer roller 53 with the intermediate transfer belt 51 interposed therebetween. The superposed toner image on the intermediate transfer belt 51 is thus collectively transferred to a sheet.

Remaining toner on the surface of each photoconductor drum 31 is removed by the cleaning blade 34, and collected into a waste toner container (not illustrated). Each charging roller 32 recharges the surface of the corresponding photoconductor drum 31 with electricity.

The fixing device 17 includes an endless fixing belt 17*a* that rotates unidirectionally, and a pressing roller 17*b* that is in contact with the peripheral surface of the fixing belt 17*a* and rotates unidirectionally. A nip portion (fixing area) is formed in an area where the fixing belt 17*a* and the pressing roller 17*b* are in pressure contact with each other.

The sheet to which the toner image is transferred by the transfer device 15 is transported to the fixing device 17 via the sheet transport device 16*a* while having the toner image unfixed. The sheet transported by the fixing device 17 has the toner image fixed by the fixing belt 17*a* and the pressing roller 17*b* with the effects of pressure contact and heating.

The sheet subjected to fixing is fed to the sheet discharger 30 via the sheet transport device 16*b*.

To output images on both surfaces of each sheet, the sheet is turned upside down by the sheet transport device 16*c* and fed again to the second transfer portion TR in the image forming portion 10. After the toner image is transferred and the transfer image is fixed, the sheet is fed to the sheet discharger 30. The sheet fed to the sheet discharger 30 is discharged to the discharged-sheet receiver after being subjected to postprocessing such as cutting or stapling as appropriate.

(2) Structure and Operation of Related Portions

Figure 2:
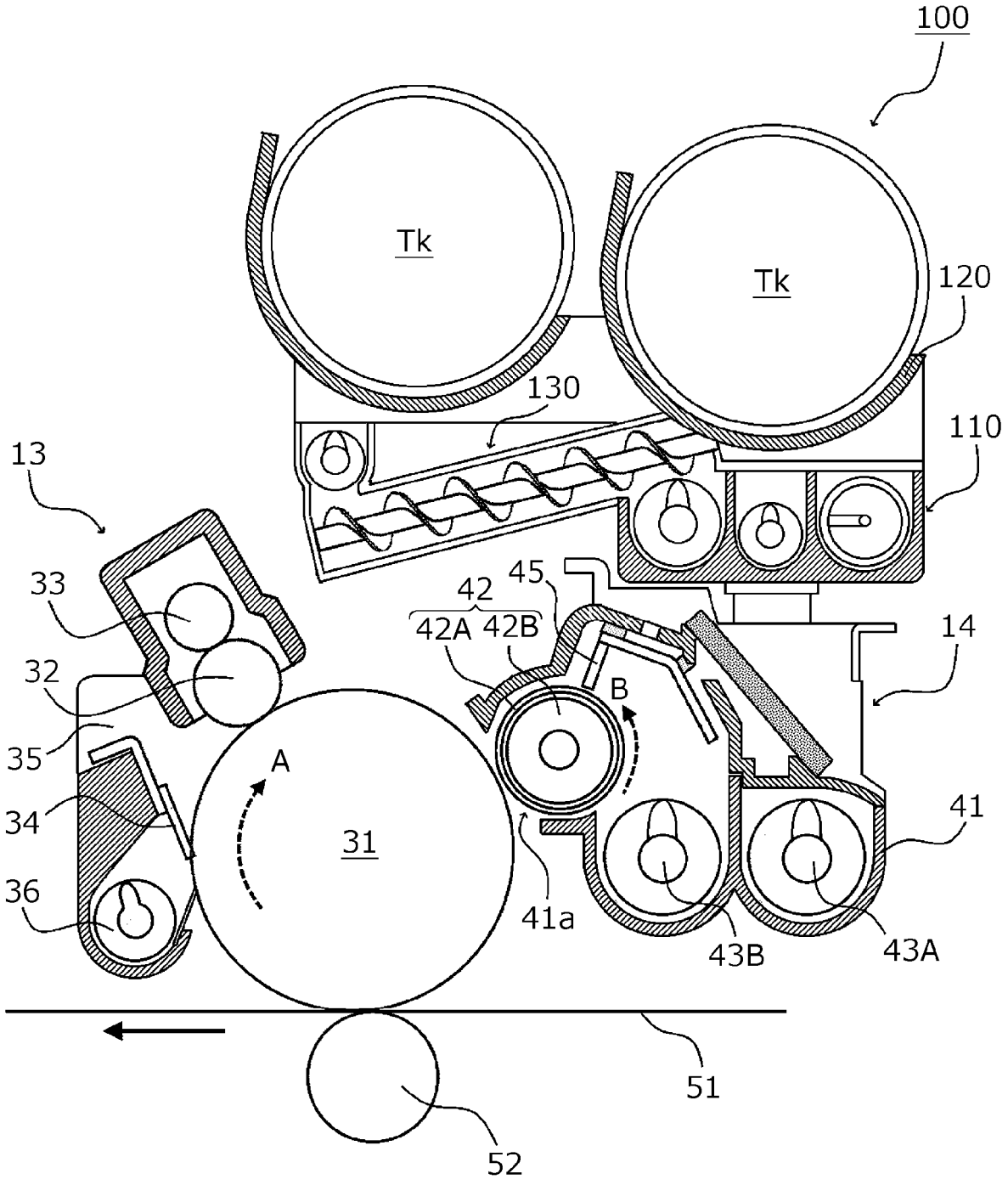
FIG. 2 is a vertically-taken cross-sectional schematic diagram of a photoconductor unit, a development device, and a powder transporting device.
Figure 3:
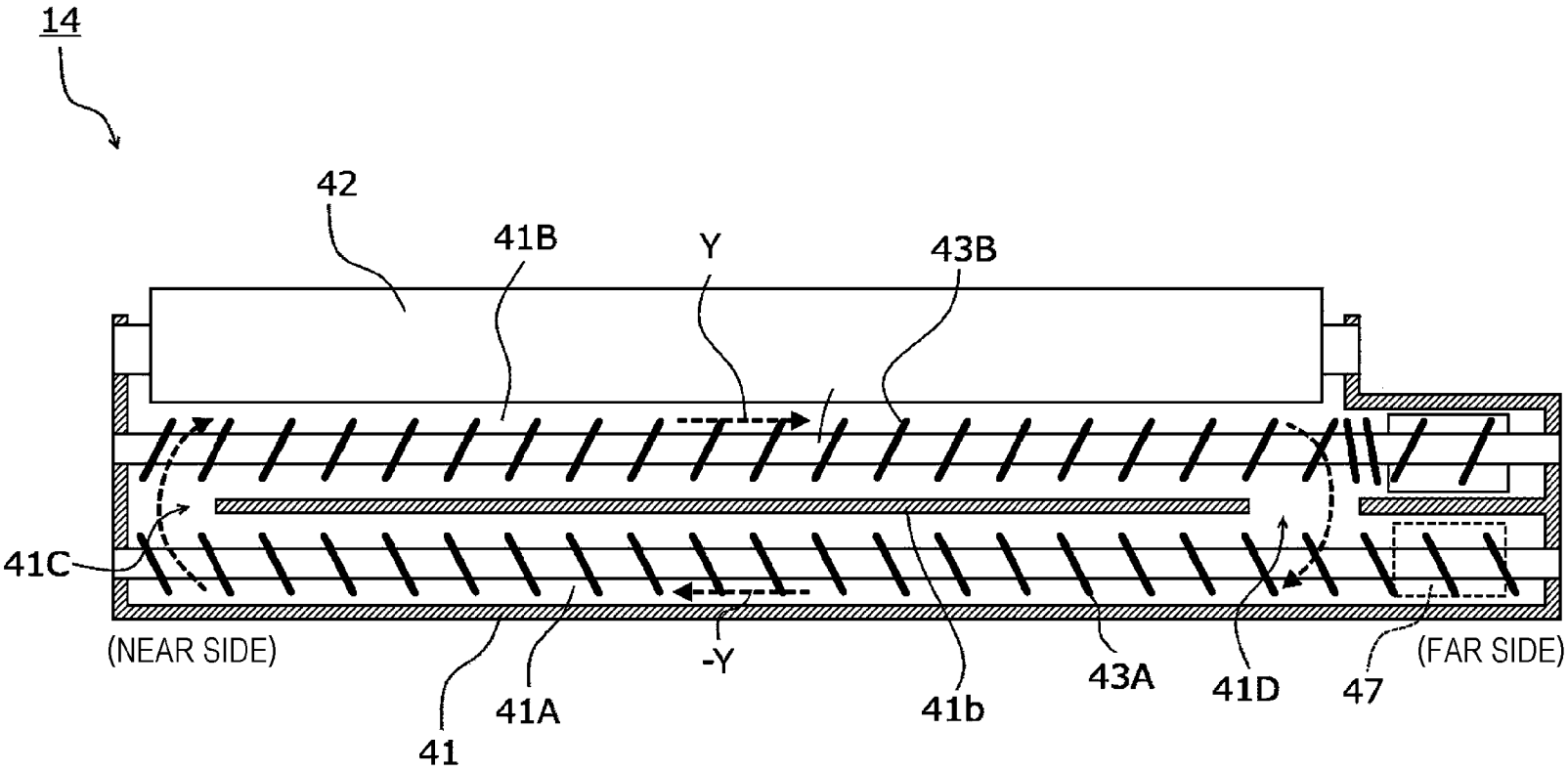
FIG. 3 is a horizontally-taken cross-sectional schematic diagram illustrating transportation of a developer in a development device.

FIG. 2 is a vertically-taken cross-sectional schematic diagram of one of the photoconductor units 13, the corresponding development device 14, and the corresponding powder transporting device 100. FIG. 3 is a horizontally-taken cross-sectional schematic diagram illustrating transportation of a developer in the development device 14. FIG.

Figure 5:
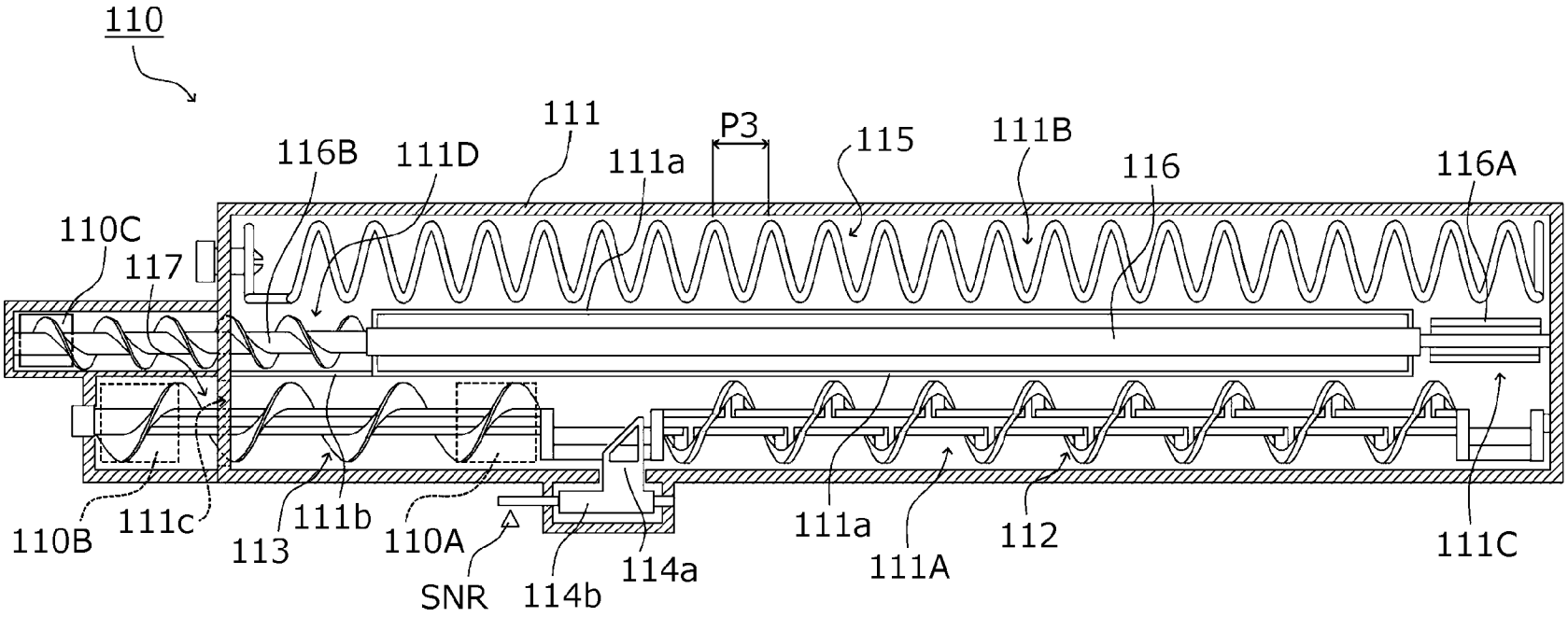
FIG. 5 is a horizontally-taken cross-sectional diagram illustrating an internal structure of a reserve tank.
Figure 6:
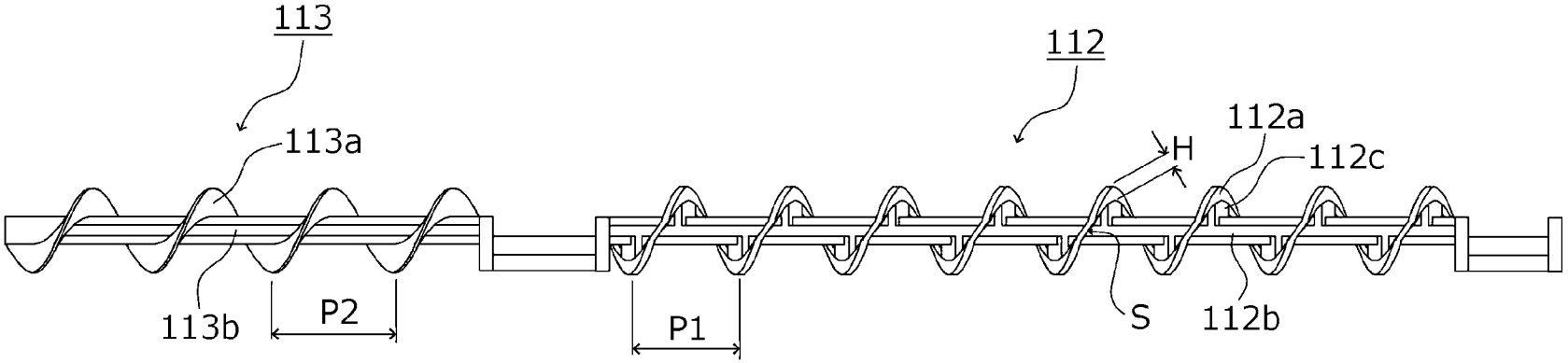
FIG. 6 is a diagram illustrating an example of a specific structure of a first transport auger and a second transport auger.

4 is a vertically-taken cross-sectional schematic diagram illustrating a structure of the powder transporting device 100. FIG. 5 is a horizontally-taken cross-sectional diagram illustrating an internal structure of a reserve tank 110. FIG. 6 is a diagram illustrating an example of a specific structure of a first transport auger 112 and a second transport auger 113.

The structure and operation of the powder transporting device 100 will be described below with reference to the drawings.

(2.1) Photoconductor Unit

In each photoconductor unit 13, the photoconductor drum 31 is rotatably supported by a unit housing 35. The unit housing 35 accommodates a charging roller 32, a cleaning roller 33, a cleaning blade 34, and a transport auger 36 that transports toner removed by the cleaning blade 34 to a waste toner collection container (not illustrated).

(2.2) Development Device

As illustrated in FIG. 2, in each development device 14, the development roller 42 is rotatably supported by the development housing 41. The development housing 41 accommodates an agitation auger 43A, a supply auger 43B, and the restrictor 45. The portion in the development housing 41 around the agitation auger 43A and the supply auger 43B is filled with the developer, and is covered with a cover member, not illustrated.

The development roller 42 opposes the outer periphery of the photoconductor drum 31 through an opening 41*a* formed in the development housing 41. The development roller 42 is solid cylindrical, and extends in a direction from the near side toward the far side of the image forming apparatus 1 (indicated in FIG. 3). The development roller 42 includes a hollow cylindrical development sleeve 42A rotatably supported by the development housing 41, and a magnet 42B that is a solid cylindrical magnet member disposed inside the development sleeve 42A and fixed to the development housing 41.

The development sleeve 42A holds the developer on its outer periphery with the magnetic force of the magnet 42B, and transports the developer with rotation of the development sleeve 42A (indicated with arrow B in FIG. 2) to the electrostatic latent image on the photoconductor drum 31.

The development device 14 also includes the supply auger 43B and the agitation auger 43A that transport the developer while agitating the developer. As illustrated in FIG. 3, a partitioning wall 41*b* stands erect inside the development housing 41 between the agitation auger 43A and the supply auger 43B to divide the development housing 41 into two developer containers 41A and 41B. The partitioning wall 41*b* has openings 41C and 41D at both ends in the longitudinal direction.

Upon receipt of the rotational force from a driving source (not illustrated), the agitation auger 43A and the supply auger 43B rotate along the inner walls of the developer containers 41A and 41B to transport the developer in a predetermined direction inside the developer containers 41A and 41B.

More specifically, the agitation auger 43A transports the developer inside the developer container 41A in the arrow (−Y) direction (toward the near side) while agitating the developer. The supply auger 43B transports the developer inside the developer container 41B in the arrow (Y) direction (toward the far side) while agitating the developer. The developer transported in the arrow (−Y) direction shifts to the developer container 41B through the opening 41C, and the developer transported in the arrow (Y) direction shifts to the developer container 41A through the opening 41D.

The developer inside the development housing 41 thus moves in a cycle while being agitated by the agitation auger 43A and the supply auger 43B. This developer agitation charges toner in the developer with electricity.

The development housing 41 has, at a first end (on the far side in the Y direction), an intake port 47 (schematically illustrated in FIG. 3 to describe the function) that receives the developer fed from the powder transporting device 100. Toner received by the development device 14 through the intake port 47 is transported by the agitation auger 43A to the developer container 41A in the development housing 41 to be mixed with the developer.

The developer fed from the powder transporting device 100 through the intake port 47 is transported from the far side (Y direction) to the near side (−Y direction) while being agitated by the agitation auger 43A to be passed to the supply auger 43B at the near side (−Y direction). The developer fed from the supply auger 43B is fed to the development roller 42.

(2.3) Powder Transporting Device

The powder transporting device 100 includes a reserve tank 110, cartridge guides 120, and a replenishment path 130. The reserve tank 110 temporarily stores the developer received from the toner cartridges Tk, and feeds the developer to the development device 14. The cartridge guides 120 guide insertion and removal of the toner cartridges T, and hold the attached toner cartridges Tk above the reserve tank 110. The replenishment path 130 allows the developer to be transported to the reserve tank 110 from the toner cartridge Tk held on one of the cartridge guides 120.

Figure 4:
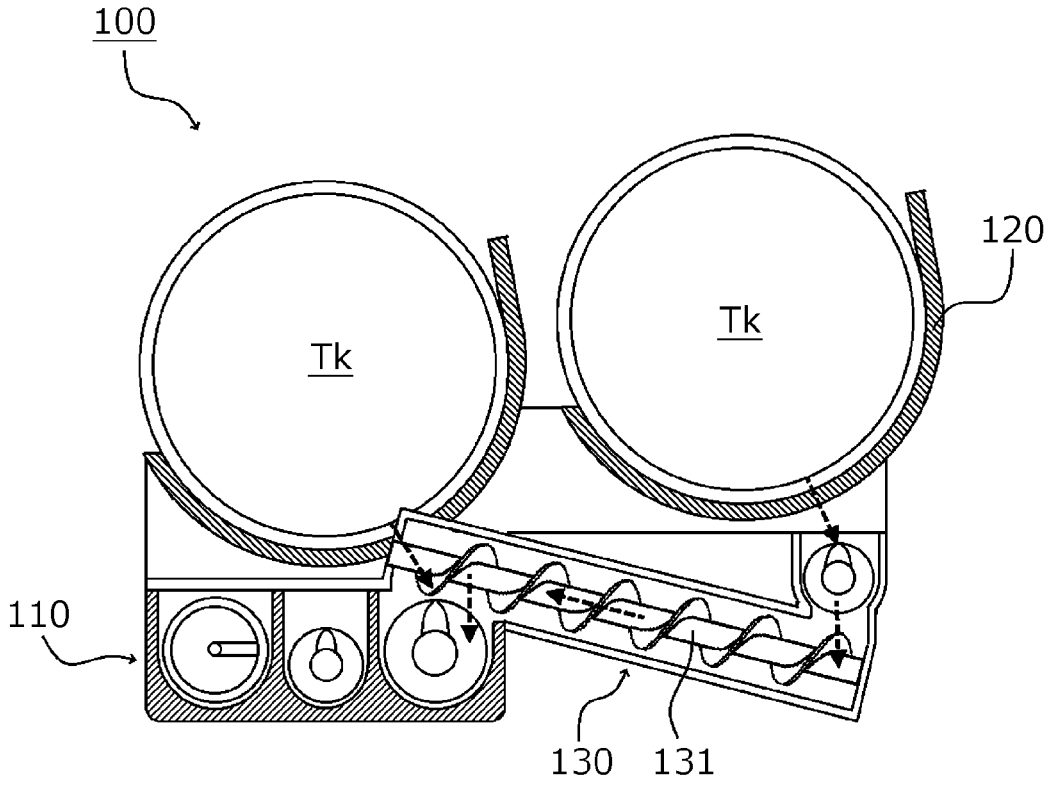
FIG. 4 is a vertically-taken cross-sectional schematic diagram illustrating a structure of a powder transporting device.

In the present exemplary embodiment, as illustrated in FIG. 4, in the powder transporting device 100 for black (K), two toner cartridges Tk are removably attached to the cartridge guides 120. The developer is directly fed from the toner cartridge Tk above the reserve tank 110 through a first supply port 110A described below. The developer is fed from the toner cartridge Tk beside the reserve tank 110 through the replenishment path 130 including a transport auger 131 and a second supply port 110B described below. In each of the powder transporting devices 100 for yellow (Y), magenta (M), and cyan (C), a single toner cartridge Ty, Tm, or Tc is removably attached, and thus no replenishment path 130 is disposed.

The powder transporting device 100 for black (K) that receives the developer from the two toner cartridges Tk will be described below.

As illustrated in FIG. 5, the reserve tank 110 includes a tank body 111 that receives the developer filled in the toner cartridges Tk to accommodate the developer, a first transport auger 112 that is rotatably disposed in the tank body 111 to transport the developer with rotation and serves as an example of a first transporter, a second transport auger 113 that serves as an example of a second transporter, and a developer detection sensor 114 that serves as an example of a detector that detects the developer accommodated in the tank body 111.

The tank body 111 having a box shape as a whole includes a partitioning wall 111*a* standing erect at the center portion to be divided into two developer containers 111A and 111B. The partitioning wall 111*a* has openings 111C and 111D at both ends of in the longitudinal direction.

The developer container 111A rotatably accommodates the first transport auger 112 and the second transport auger 113, and forms one of the circulation paths that allows the developer to circulate. The developer container 111B rotatably accommodates a coil auger 115 formed by helically winding a metal wire rod, and forms the other circulation path that accommodates the developer fed from the developer container 111A through the opening 111C for transportation. In the present exemplary embodiment, the developer container 111A and the developer container 111B are connected to each other with the openings 111C and 111D at both ends to form a developer circulation path.

The tank body 111 is covered with a lid and accommodates the developer inside. The lid has a first supply port 110A (drawn with a broken line in FIG. 5) that receives the developer from one of the toner cartridges Tk in a middle portion of the developer container 111A.

A transport path 117 is connected to a first end of the tank body 111. The transport path 117 receives the developer fed from the other one of the toner cartridges Tk, and is merged with the developer container 111A to enable transportation of the developer into the circulation path. The second supply port 110B (drawn with a broken line in FIG. 5) is disposed at a first end of the transport path 117. The second supply port 110B receives the developer fed from the other toner cartridge Tk and transported along the replenishment path 130. Specifically, the transport path 117 is merged with the developer container 111A serving as a first circulation path inside the tank body 111 across the side wall of the tank body 111, and allows transportation of the developer fed from the other toner cartridge Tk into the tank body 111.

A through-hole 111*c* formed in a side wall of the tank body 111 to connect the transport path 117 to the developer container 111A has an inside diameter smaller than the inside diameter of the developer container 111A. This structure prevents the developer from flowing backward from the developer container 111A to the transport path 117.

The developer detection sensor 114 that detects the amount of the developer accommodated in the developer container 111A is disposed downstream from the first supply port 110A of the tank body 111. The developer detection sensor 114 includes a movable piece 114*a* and a rotation shaft 114*b* to which the movable piece 114*a* is rotatably attached to detect the presence or absence of the developer with an optical sensor SNR disposed at the end of the rotation shaft 114*b*. The developer detection sensor 114 may be formed from a highly sensitive inductance sensor disposed without being exposed through the side wall of the tank body 111.

In the developer container 111A of the tank body 111 serving as one of the circulation paths, the helical first transport auger 112 and the helical second transport auger 113 are disposed rotatably about the rotation shaft. In the developer container 111B of the tank body 111 serving as the other one of the circulation paths, the coil auger 115 is rotatably disposed.

Inside the partitioning wall 111*a* between the first transport auger 112 and the coil auger 115 in a plan view, an auxiliary transport auger 116 is rotatably disposed. The auxiliary transport auger 116 includes a paddle 116A disposed in the opening 111C at one end and a helical blade 116B disposed near the opening 111D at the other end. The paddle 116A passes the developer from the first transport auger 112 to the coil auger 115 (refer to arrow A in FIG. 7). The helical blade 116B feeds the circulating developer to an outlet port 110C (refer to arrow B in FIG. 7). A partitioning wall 111*b* shorter than the partitioning wall 111*a* stands erect at the boundary between the developer containers 111A and the 111B in the opening 111D to prevent the developer from flowing backward with respect to the circulation direction.

FIG. 6 illustrates an example of a specific structure of the first transport auger 112 and the second transport auger 113.

The first transport auger 112 includes a helical blade 112*a* and a shaft 112*b* spaced a predetermined gap S apart from the helical blade 112*a*. Specifically, the shaft 112*b* and the blade 112*a* are coupled at support portions 112*c* while retaining the gap S substantially the same as a blade height H. Thus, the developer transported in the developer container 111A by the first transport auger 112 is allowed to pass through the gap S, and is transported at a lower speed than when transported by the transport auger including a shaft and a helical blade disposed without leaving a gap from the shaft.

The second transport auger 113 includes a shaft 113*b* and a helical blade 113*a*. The helical blade 113*a* is a resin auger disposed on the outer periphery of the shaft 113*b* at a helical pitch P2 longer than a helical pitch P1 of the first transport auger 112. The outside diameter of the blade 113*a* in the direction crossing the shaft 113*b* is substantially the same as that of the first transport auger 112. Thus, the second transport auger 113 transports the developer at a transport speed V2, higher than a transport speed V1 of the first transport auger 112. The outside diameter of the second transport auger 113 is larger than the outside diameter of the helical blade 116B of the auxiliary transport auger 116. Thus, the transport speed V2 at which the second transport auger 113 transports the developer is higher than the speed at which the auxiliary transport auger 116 feeds the developer to the outlet port 110C, more specifically, two or more times higher than the speed at which the auxiliary transport auger 116 feeds the developer to the outlet port 110C. The transport speed V2 of the second transport auger 113 is approximately twice higher than the transport speed at which transport members in a circulation path, that is, the first transport auger 112, the coil auger 115, and the auxiliary transport auger 116 transport the developer. Specifically, the transport speed V2 at which the second transport auger 113 transports the developer is the highest in the developer circulation paths.

As illustrated in FIG. 5, the second transport auger 113 with this structure extends to the transport path 117 from the developer container 111A serving as one of the circulation paths in the tank body 111. Specifically, the second transport auger 113 is disposed through the side wall of the tank body 111 from the position where the second supply port 110B is disposed to the position where the first supply port 110A is disposed. The second transport auger 113 transports the developer fed from the second supply port 110B into the tank body 111, and prevents accumulation of the developer with an increase of a transport capacity of the developer at the merging portion between the circulation paths.

Thus, the second transport auger 113 is disposed at least throughout the entirety of the area where the transport path 117 is merged with the circulation path to transport the developer at the transport speed V2 higher than the transport speed V1 of the first transport auger 112.

Preferably, the second transport auger 113 is disposed in an area in front of the position where the developer detection sensor 114 is disposed. This structure prevents stagnation of the developer in front of the developer detection sensor 114, and enables stabilization of developer detection.

The coil auger 115 is a transport auger formed by helically winding a metal wire rod at a helical pitch P3 smaller than that of the first transport auger 112. The developer transport speed is lower than the transport speed V1 of the first transport auger 112. The coil auger 115 temporarily stores the developer while agitating the developer in the developer container 111B to thus provide, to the reserve tank 110, a reserve function of the developer to be fed to the development device 14. This function enables replacement of the toner cartridge T while a high-speed image forming apparatus is in operation without stopping the apparatus during serial printing.

(2.4) Operation of Powder Transporting Device

Figure 7:
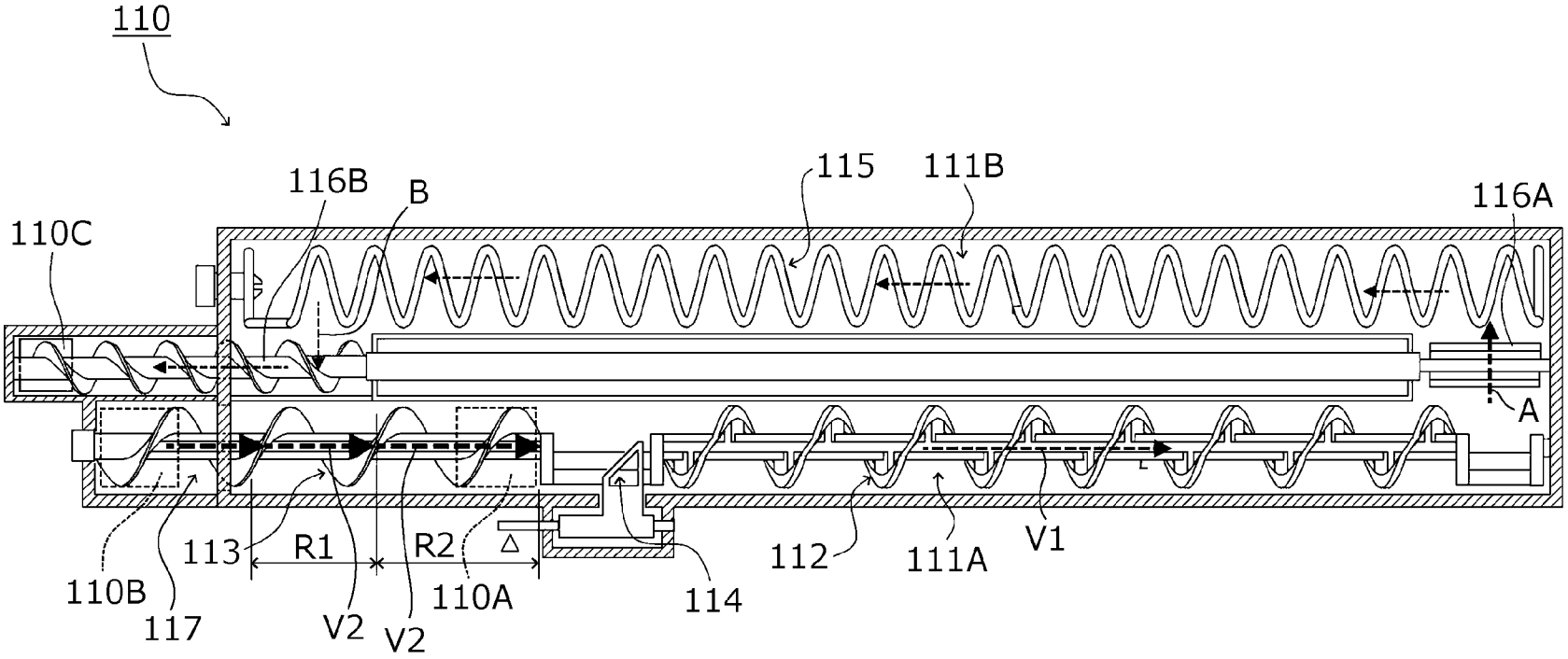
FIG. 7 is a schematic plan view illustrating transportation and circulation of a developer in a reserve tank.

FIG. 7 is a schematic plan view illustrating transportation and circulation of the developer in the reserve tank 110.

In the powder transporting device 100 according to the present exemplary embodiment, the developer fed from one of the toner cartridges Tk flows into the developer container 111A in the tank body 111 through the first supply port 110A. The developer fed from the other toner cartridge Tk is transported along the replenishment path 130, received by the transport path 117 through the second supply port 110B, and transported along the transport path 117 to flow into the merging portion of the developer container 111A.

In a structure where the developer from the transport path 117 flows into the circulation path to merge, the developer may be temporarily accumulated, and clogged at the second supply port 110B and the through-hole 111*c* serving as a connection portion between the transport path 117 and the tank body 111. In addition, the developer may flow backward at the merging portion, and the unintended backflow developer may be fed to the development device 14.

In the reserve tank 110 according to the present exemplary embodiment, the second transport auger 113 extending from the developer container 111A, which is one of the circulation paths in the tank body 111, to the transport path 117 transports the developer at a higher transport speed than the first transport auger 112 disposed downstream in the circulation path.

Specifically, the second transport auger 113 transports the developer at the transport speed V2 higher than the transport speed V1 of the first transport auger 112 in at least the entirety of the area (area R1 in FIG. 7) where the transport path 117 merges with the circulation path. This structure enables stable feeding of the developer to the development device 14 while the developer is prevented from being accumulated at the merging portion to reduce clogging. Particularly, the second transport auger 113 transports the developer at the transport speed V2 higher than the transport speed V1 of the first transport auger 112 in the area (area R2 in FIG. 7) in front of the position where the developer detection sensor 114 is disposed. Thus, stagnation of the developer in front of the developer detection sensor 114 is prevented, and detection of the developer is stabilized.

(3) Driving of Powder Transporting Device

Figure 8:
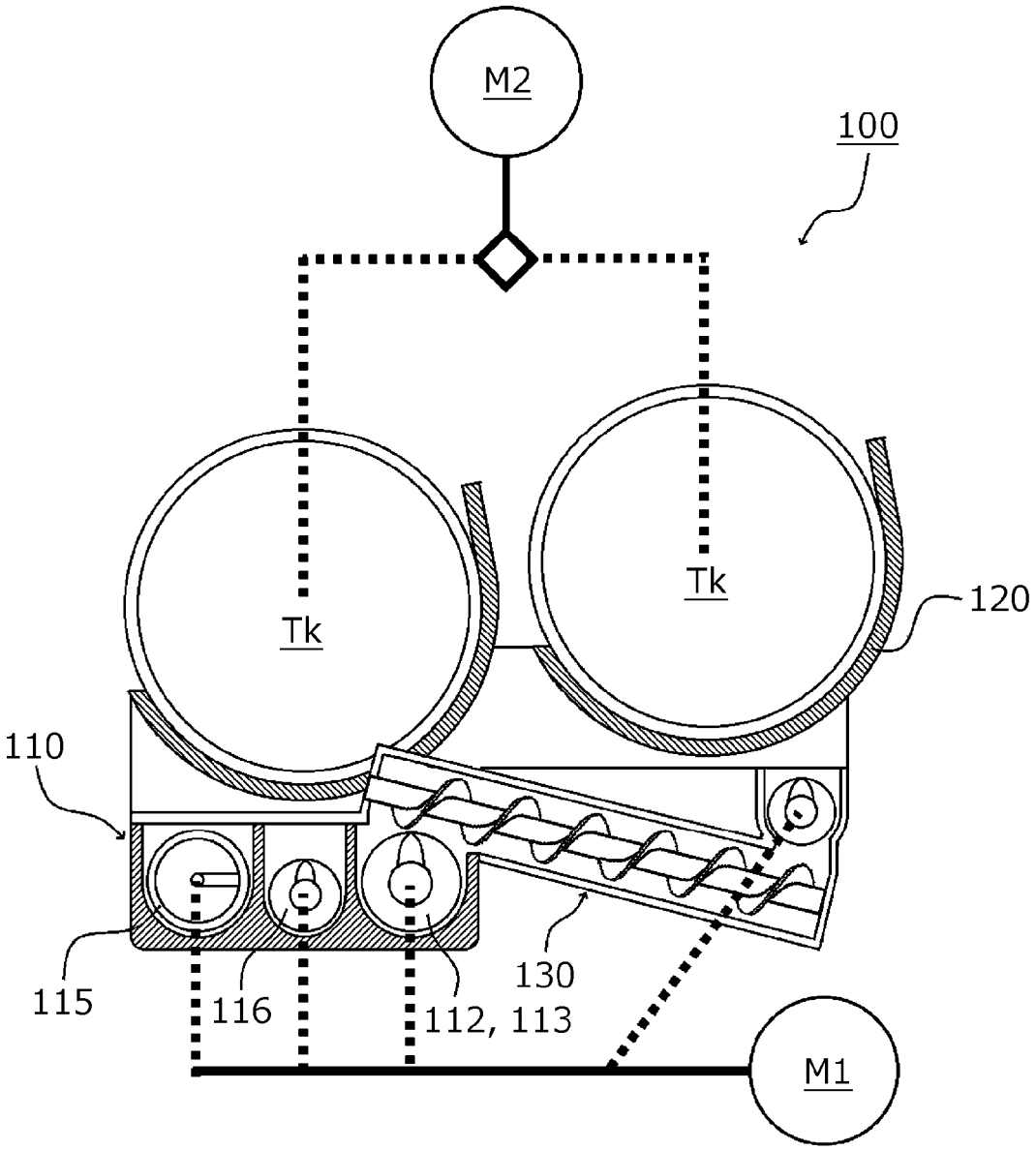
FIG. 8 is a diagram illustrating transmission of a driving force of a powder transporting device viewed from the far side.

FIG. 8 is a diagram illustrating transmission of a driving force of the powder transporting device 100 viewed from the far side.

As illustrated in FIG. 8, the powder transporting device 100 includes the reserve tank 110, the cartridge guides 120, and the replenishment path 130 integrated together. The powder transporting device 100 includes a first motor M1 that drives the reserve tank 110 and the replenishment path 130, and a second motor M2 that drives the two toner cartridges Tk. Driving devices including the first motor M1 and the second motor M2 are disposed at the far side of the powder transporting device 100. The powder transporting device 100 is removable and attachable from the front side of the image forming apparatus 1.

The first transport auger 112, the second transport auger 113, and the auxiliary transport auger 116 are rotatably supported by the tank body 111 in the reserve tank 110, and rotatably driven by the first motor M1 via a gear train including multiple gears.

Either one of the two toner cartridges Tk rotatably attached to the cartridge guides 120 is driven to rotate by the second motor M2 by switching the rotation direction of the second motor M2. In the powder transporting device 100, the reserve tank 110 and the toner cartridges Tk are driven by the separate motors. The two toner cartridges Tk that are not required to be simultaneously driven are driven by a single motor (second motor M2) by switching the rotation direction of the motor. Thus, a reasonable structure is achieved.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder transporting device, comprising:

a circulation path that receives and accommodates a developer from a plurality of toner cartridges filled with the developer, and along which the accommodated developer is transported while circulating;

a first supply port that allows the developer to be fed onto the circulation path;

a transport path that merges with the circulation path at a portion of the circulation path upstream from the first supply port to allow the developer to be transported therealong into the circulation path;

a second supply port through which the developer is fed to the transport path;

a detector that detects the developer accommodated in the circulation path;

a first transporter that transports the developer in the circulation path at a first transport speed; and a second transporter that extends along the transport path in the circulation path, and that transports the developer into the circulation path at a second transport speed higher than the first transport speed.

2. The powder transporting device according to claim 1, wherein the second transporter transports the developer at the second transport speed in at least an area in the circulation path where the transport path merges with the circulation path.

3. The powder transporting device according to claim 1, wherein the second transporter transports the developer at the second transport speed in an area in the circulation path in front of a position where the detector is disposed.

4. The powder transporting device according to claim 1, wherein the second transport speed is equal to or higher than twice a transport speed at which the developer is discharged from the circulation path.

5. The powder transporting device according to claim 2, wherein the second transport speed is equal to or higher than twice a transport speed at which the developer is discharged from the circulation path.

6. The powder transporting device according to claim 3, wherein the second transport speed is equal to or higher than twice a transport speed at which the developer is discharged from the circulation path.

7. The powder transporting device according to claim 1, wherein the second transporter includes a shaft and a helical blade disposed on the shaft at a predetermined helical pitch, the second transporter is rotatable together with the first transporter including a shaft and a helical blade spaced a predetermined gap apart from the shaft to allow the developer to pass through the gap, and the second transporter has a larger capacity of transporting the developer than the first transporter.

8. The powder transporting device according to claim 2, wherein the second transporter includes a shaft and a helical blade disposed on the shaft at a predetermined helical pitch, the second transporter is rotatable together with the first transporter including a shaft and a helical blade spaced a predetermined gap apart from the shaft to allow the developer to pass through the gap, and the second transporter has a larger capacity of transporting the developer than the first transporter.

9. The powder transporting device according to claim 3, wherein the second transporter includes a shaft and a helical blade disposed on the shaft at a predetermined helical pitch, the second transporter is rotatable together with the first transporter including a shaft and a helical blade spaced a predetermined gap apart from the shaft to allow the developer to pass through the gap, and the second transporter has a larger capacity of transporting the developer than the first transporter.

10. The powder transporting device according to claim 4, wherein the second transporter includes a shaft and a helical blade disposed on the shaft at a predetermined helical pitch, the second transporter is rotatable together with the first transporter including a shaft and a helical blade spaced a predetermined gap apart from the shaft to allow the developer to pass through the gap, and the second transporter has a larger capacity of transporting the developer than the first transporter.

11. The powder transporting device according to claim 5, wherein the second transporter includes a shaft and a helical blade disposed on the shaft at a predetermined helical pitch, the second transporter is rotatable together with the first transporter including a shaft and a helical blade spaced a predetermined gap apart from the shaft to allow the developer to pass through the gap, and the second transporter has a larger capacity of transporting the developer than the first transporter.

12. The powder transporting device according to claim 6, wherein the second transporter includes a shaft and a helical blade disposed on the shaft at a predetermined helical pitch, the second transporter is rotatable together with the first transporter including a shaft and a helical blade spaced a predetermined gap apart from the shaft to allow the developer to pass through the gap, and the second transporter has a larger capacity of transporting the developer than the first transporter.

13. The powder transporting device according to claim 1, wherein the circulation path is integrated with a guide that guides insertion and removal of the toner cartridges and holds the toner cartridges above the circulation path.

14. The powder transporting device according to claim 2, wherein the circulation path is integrated with a guide that guides insertion and removal of the toner cartridges and holds the toner cartridges above the circulation path.

15. The powder transporting device according to claim 3, wherein the circulation path is integrated with a guide that guides insertion and removal of the toner cartridges and holds the toner cartridges above the circulation path.

16. The powder transporting device according to claim 4, wherein the circulation path is integrated with a guide that guides insertion and removal of the toner cartridges and holds the toner cartridges above the circulation path.

17. The powder transporting device according to claim 1, wherein the powder transporting device is removably attached from a front side of the image forming apparatus.

18. The powder transporting device according to claim 1, wherein a single driving source drives either of the plurality of toner cartridges while switching a rotation direction thereof.

19. The powder transporting device according to claim 18, wherein a driving source different from the driving source that drives either of the plurality of toner cartridges drives the first transporter and the second transporter to rotate.

20. An image forming apparatus, comprising:

an image carrier having a surface on which an electrostatic latent image is formed;

a development device that develops the electrostatic latent image on the image carrier with a developer containing at least toner; and that powder transporting device according to claim 1 that feeds the developer in the toner cartridge to the development device.

* * * * *